US010974313B2

(12) United States Patent
Dodds et al.

(10) Patent No.: US 10,974,313 B2
(45) Date of Patent: Apr. 13, 2021

(54) CORE PATTERN REFORMER TOOL

(71) Applicant: CHROMALLOY GAS TURBINE LLC, Palm Beach Gardens, FL (US)

(72) Inventors: Gerald Clement Dodds, Lutz, FL (US); Thomas John Molkentin, Lithia, FL (US)

(73) Assignee: Chromalloy Gas Turbine LLC, Palm Beach Gardens, FL (US)

( * ) Notice: Subject to any disclaimer, the term of this patent is extended or adjusted under 35 U.S.C. 154(b) by 78 days.

(21) Appl. No.: 16/413,030

(22) Filed: May 15, 2019

(65) Prior Publication Data

US 2020/0360985 A1 Nov. 19, 2020

(51) Int. Cl.

| | |
|---|---|
| ***B22C 9/10*** | (2006.01) |
| ***B22C 7/02*** | (2006.01) |
| ***B22C 7/06*** | (2006.01) |
| ***B22C 9/22*** | (2006.01) |
| ***B22C 9/06*** | (2006.01) |

(52) U.S. Cl.

CPC ..... *B22C 9/22* (2013.01); *B22C 7/02* (2013.01); *B22C 7/065* (2013.01); *B22C 9/067* (2013.01); *B22C 9/10* (2013.01); *B22C 9/101* (2013.01); *B22C 9/106* (2013.01)

(58) Field of Classification Search

CPC .... B22C 7/02; B22C 7/06; B22C 9/10; B28B 11/243; B28B 11/248

See application file for complete search history.

(56) References Cited

U.S. PATENT DOCUMENTS

| | | | | |
|---|---|---|---|---|
| 5,403,058 | A * | 4/1995 | Fischer | B60R 7/082 16/82 |
| 7,780,905 | B2 * | 8/2010 | Dodds | F27D 3/0021 264/607 |
| 7,913,743 | B2 * | 3/2011 | Bedzyk | B22C 9/10 164/45 |
| 10,252,325 | B1 * | 4/2019 | Troitino Lopez | B22C 9/10 |

* cited by examiner

*Primary Examiner* — Kevin E Yoon

(74) *Attorney, Agent, or Firm* — Avant Law Group, LLC

(57) ABSTRACT

A core pattern reformer system for adjusting and setting a core pattern for use in casting a gas turbine blade has a first portion having a first internal face with a concave portion. The first portion is coupled to a second portion. The second portion has a second internal face with a convex portion. A plurality of adjustable pins is positioned along the internal faces of the first portion and the second portion. The pins have a height that is adjustable with respect to the internal faces. A locking mechanism is included for securing the first portion to the second portion. The system includes one or more air inlets and one or more air exits and a source of cooling air coupled to the one or more air inlets.

20 Claims, 7 Drawing Sheets

CORE PATTERN REFORMER TOOL

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

This disclosure relates generally to a tool for reforming a core pattern. More specifically, the disclosure relates to a tool for selectively reforming a core pattern used in an investment casting process for casting a gas turbine component, and to methods of making and using this core pattern reformer tool.

BACKGROUND OF THE DISCLOSURE

A gas turbine engine typically comprises a multi-stage compressor coupled to a multi-stage turbine via an axial shaft. Air enters the gas turbine engine through the compressor where its temperature and pressure are increased as it passes through subsequent stages of the compressor. The compressed air is then directed to one or more combustors where it is mixed with a fuel source to create a combustible mixture. This mixture is ignited in the combustors to create a flow of combustion gases. These gases are directed into the turbine causing the turbine to rotate, thereby driving the compressor. The output of the gas turbine engine can be mechanical thrust through exhaust from the turbine or shaft power from the rotation of an axial shaft, where the axial shaft can drive a generator to produce electricity. Due to the operating temperatures of the gas turbine engine, it is necessary for one or more stages of turbine blades and vanes to be cooled. Depending on the operating temperatures, certain gas turbine components are hollow.

Hollow cooled gas turbine components are typically cast metal manufactured using a lost wax investment casting process. The lost wax investment casting process has been known for thousands of years, and as such, is not discussed at length herein. In brief, a core having the internal profile of the part to be cast (e.g., of a gas turbine blade or vane) is first fabricated. The core is placed in a die having the profile of the gas turbine blade or vane and wax is injected around the core. The core is shelled and the wax is melted out, leaving the hollow void equivalent to the wall thicknesses of the turbine blade or vane. The metal is poured and cooled and after solidifying, the core material is removed through a leaching process.

It is critical that the turbine components have proper wall thicknesses in order to handle the thermal and mechanical loading applied to the components. An unsuitably thin wall in an airfoil can lead to failure of the gas turbine, which may be catastrophic. The unsuitably thin wall may result because of the misalignment of the core (e.g., ceramic core) within the wax pattern. Misalignment of the core can occur when the geometry of the core includes imprecisions.

BRIEF SUMMARY OF THE DISCLOSURE

The present disclosure discloses a system and process for reforming a core pattern used in the casting process of a gas turbine component.

In an embodiment of the present disclosure, a reforming tool for a core pattern is disclosed. The core reforming tool for a core pattern comprises a first portion having a first internal face with a concave portion, a second portion having a second internal face with a convex portion, and a plurality of adjustable pins extending away from the first and second internal faces. The pins have a height that is adjustable with respect to the first and second internal faces. A locking mechanism is provided for securing the first portion to the second portion. The reforming tool also includes one or more air inlets and one or more air exits. In the reforming tool, the core pattern is supported and repositioned by the plurality of adjustable pins and is cooled by air passing through the reforming tool.

In an alternate embodiment of the present disclosure, a method of reforming a core pattern is provided. The method of reforming the core pattern comprises providing a core pattern corresponding to an internal profile of a turbine blade core and adjusting one or more pins of a core reforming tool. The core reforming tool has a first portion with a concave portion and a second portion with a convex portion. Then, the core pattern is positioned in the core reforming tool. The core reforming tool is closed such that the second portion is moved towards the first portion and cooling air is directed through the core reforming tool and solidifies the core pattern.

In yet another embodiment of the present disclosure, a system for adjusting and setting a core pattern for use in casting a gas turbine blade is disclosed. The system for adjusting and setting a core pattern for use in casting a gas turbine blade comprises a first portion having a first internal face with a concave portion. The first portion is coupled to a second portion. The second portion has a second internal face with a convex portion. A plurality of adjustable pins is positioned along the internal faces of the first portion and the second portion. The pins have a height that is adjustable with respect to the internal faces. A locking mechanism is included for securing the first portion to the second portion. The system also includes one or more air inlets and one or more air exits as well as a source of cooling air coupled to the one or more air inlets.

These and other features of the present disclosure can be best understood from the following description and claims.

BRIEF DESCRIPTION OF THE SEVERAL VIEWS OF THE DRAWINGS

The present disclosure is described in detail below with reference to the attached drawing figures, wherein.

DETAILED DESCRIPTION OF THE DISCLOSURE

The present disclosure is intended for use in the manufacturing of components for use in a gas turbine engine, such as for use with casting hollow turbine components. As such, the present disclosure is capable of being used in a variety of turbine operating environments, regardless of the manufacturer.

Those skilled in the art understand that the lost wax investment casting process can be used to accurately fabricate intricate components. Gas turbine blades and vanes, because of their geometric complexity, high-temperature material requirements, and tight tolerances, are often cast using the lost wax investment casting process. The process includes creating a ceramic core, around which the metal is poured and cooled.

The ceramic core making process involves the injection molding of a pattern of the core utilizing core mix comprised of ceramic particulate dispersed within a thermoplastic binder system. The core cools and is fired in an oven to harden the material for use in casting. It is imperative that the core pattern be dimensionally accurate, as imprecisions in the core may lead to imperfections in the blade or vane being cast. For example, a core created with dimensionally inaccurate characteristics may result in a final turbine component having an unsuitable wall thickness.

In the prior art, after the core pattern is removed from the mold, the core pattern is typically cooled and allowed to set either in a press setter or in a template style reformer. The press setter has a split enclosure and is non-adjustable. The template style reformer only allows for the core pattern to be minimally adjusted. The prior art mechanisms to cool and set the core pattern do not allow the core pattern to be selectively adjusted effectively. Such selective adjustability of the core pattern may allow for any deficiencies in the core to be corrected before it is set, and consequently, decrease the likelihood that the core formed using the pattern will have deficiencies that result from imprecisions in the core pattern.

FIGS. 1-7 show a pin style reformer tool 100 for selectively reforming a core pattern for use in a casting process, according to an embodiment of the present disclosure. A core pattern may be removed from the mold and situated within the reformer tool 100. The core pattern may be taken out of the mold and situated within the reformer tool 100 while the core pattern is still warm, as the warm core pattern may be more amenable to selective adjustment via the reformer tool 100 relative to a core pattern that has cooled. The reformer tool 100 may be used to selectively adjust one or more surfaces of the core pattern. The adjusted core pattern may be cooled in the reformer tool 100, and the cooled core pattern may then be removed therefrom after it has set and fired to make the core as discussed above.

Figure 1:
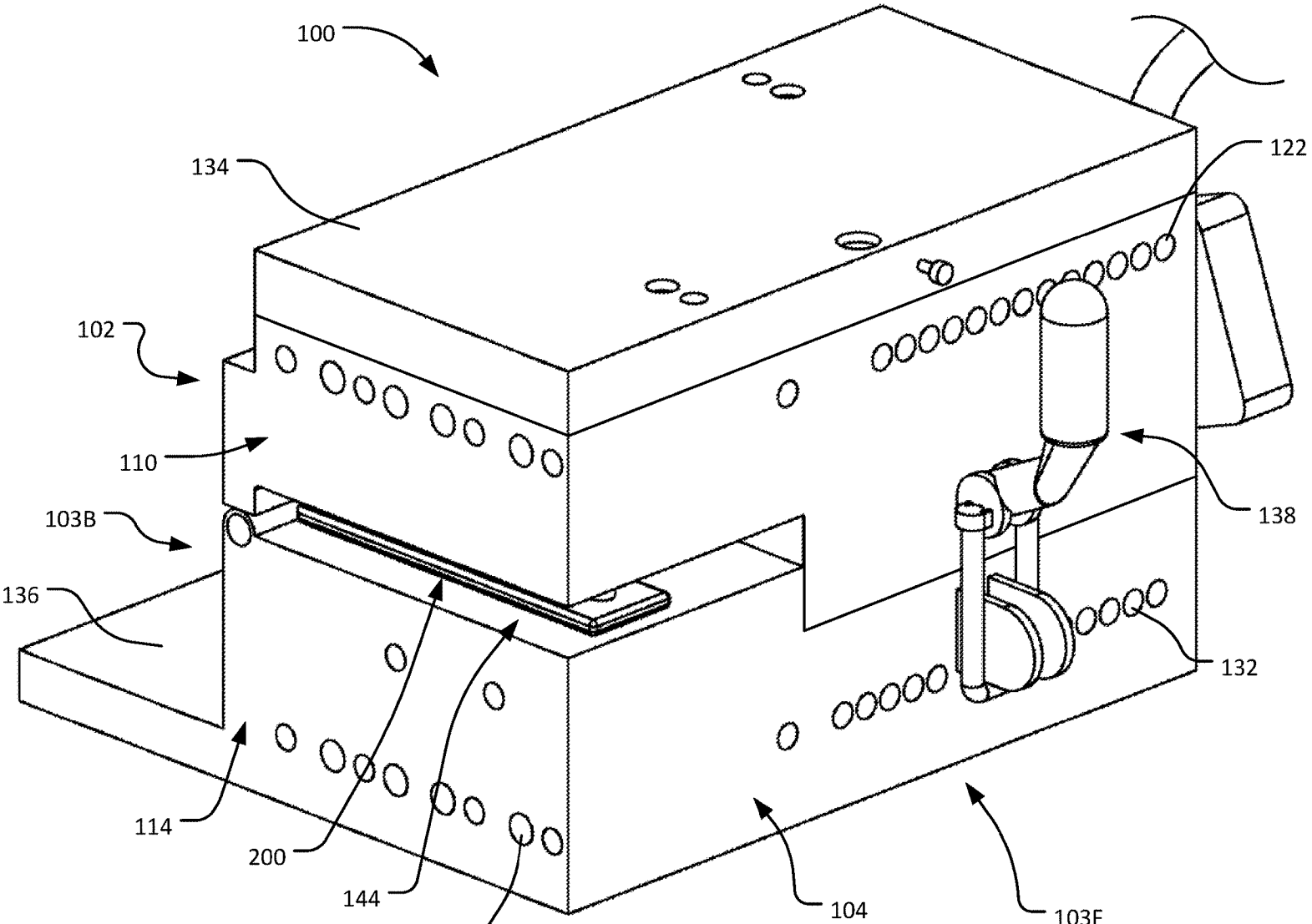
FIG. 1 is a perspective view of a core pattern reforming tool in accordance with an embodiment of the present disclosure, showing the tool in a closed position.
Figure 2:
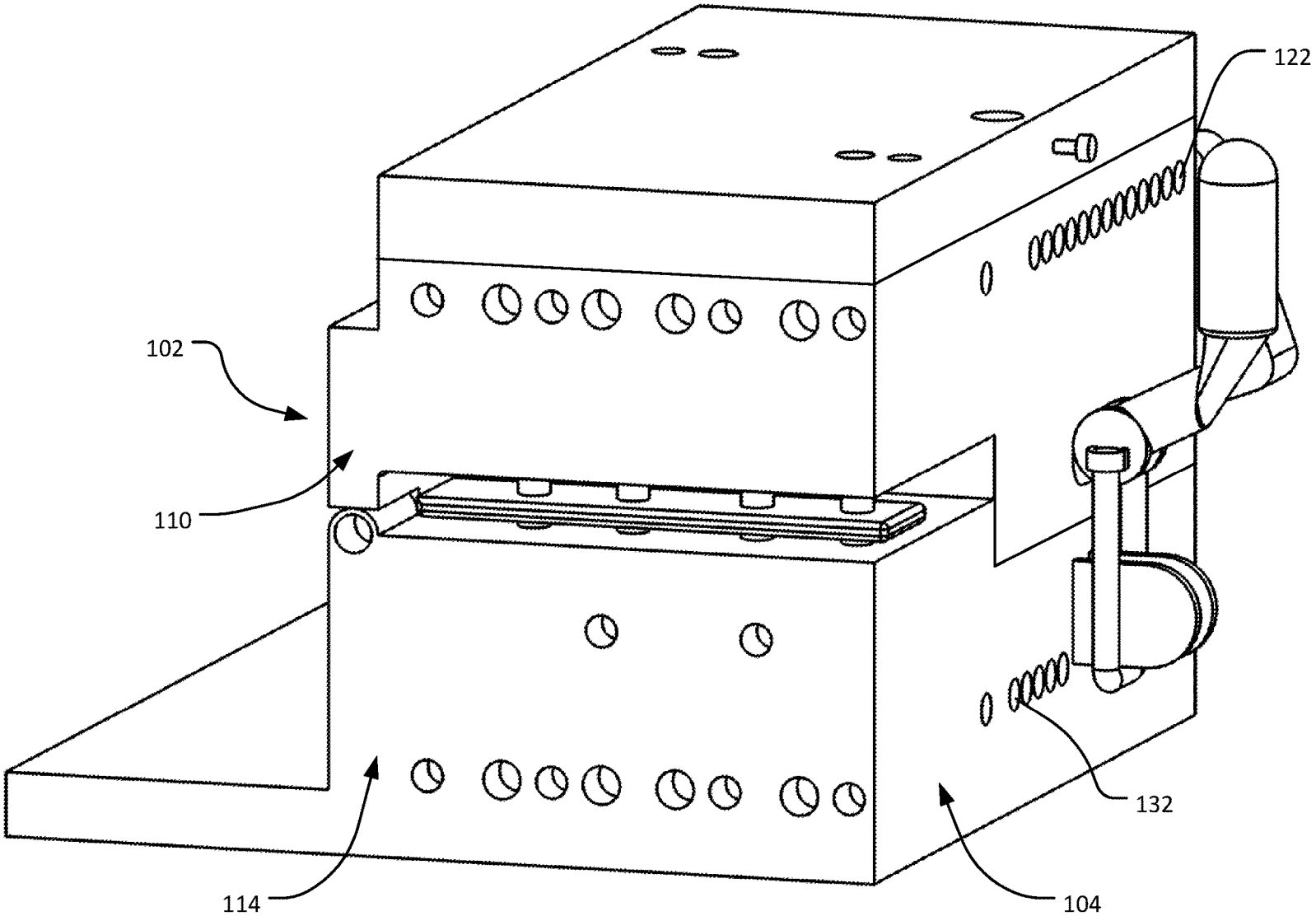
FIG. 2 is another perspective view of the core pattern reforming tool of FIG. 1 in the closed position.
Figure 3:
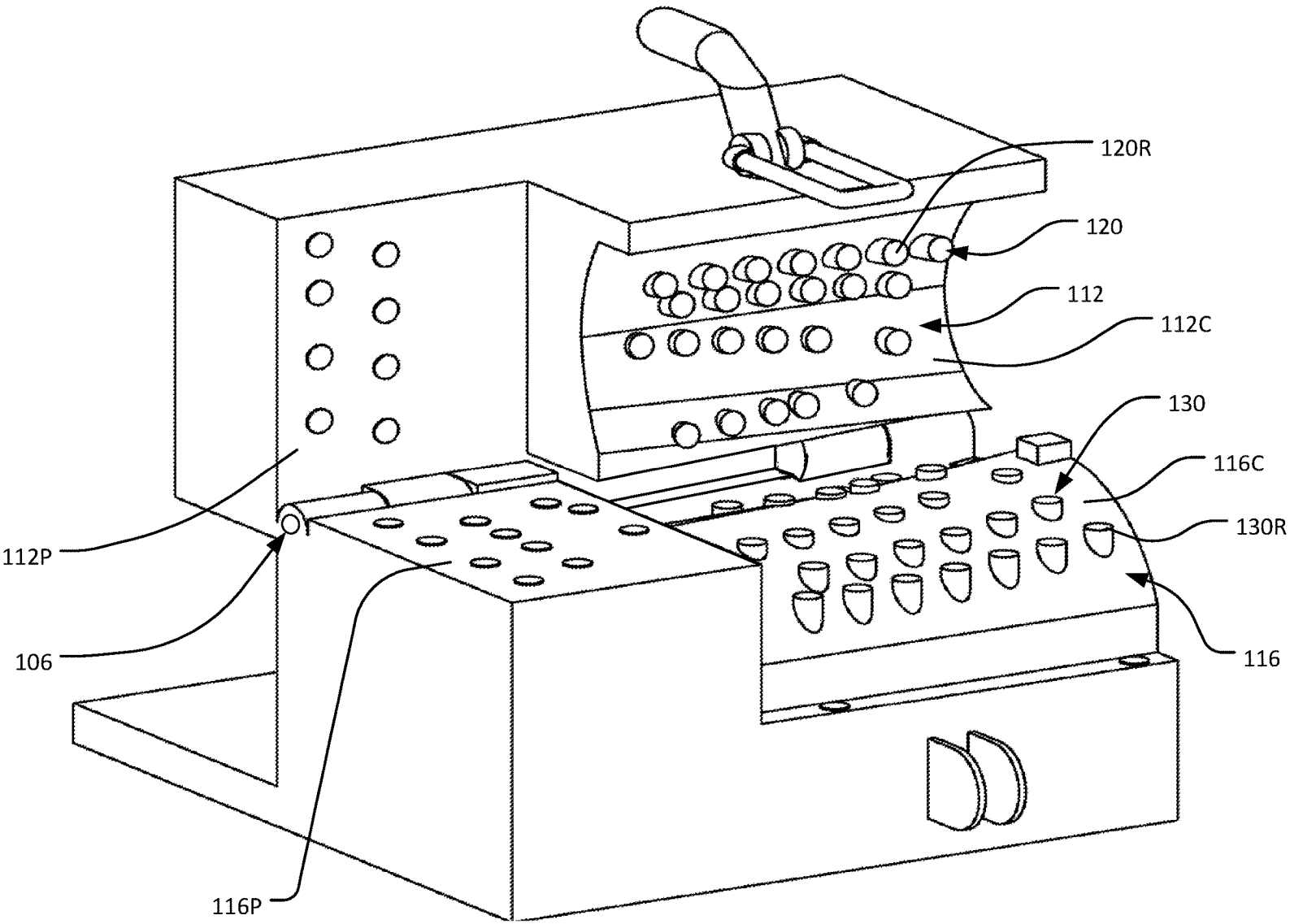
FIG. 3 is a perspective view of the core pattern reforming tool of FIG. 1 in an open position.
Figure 4:
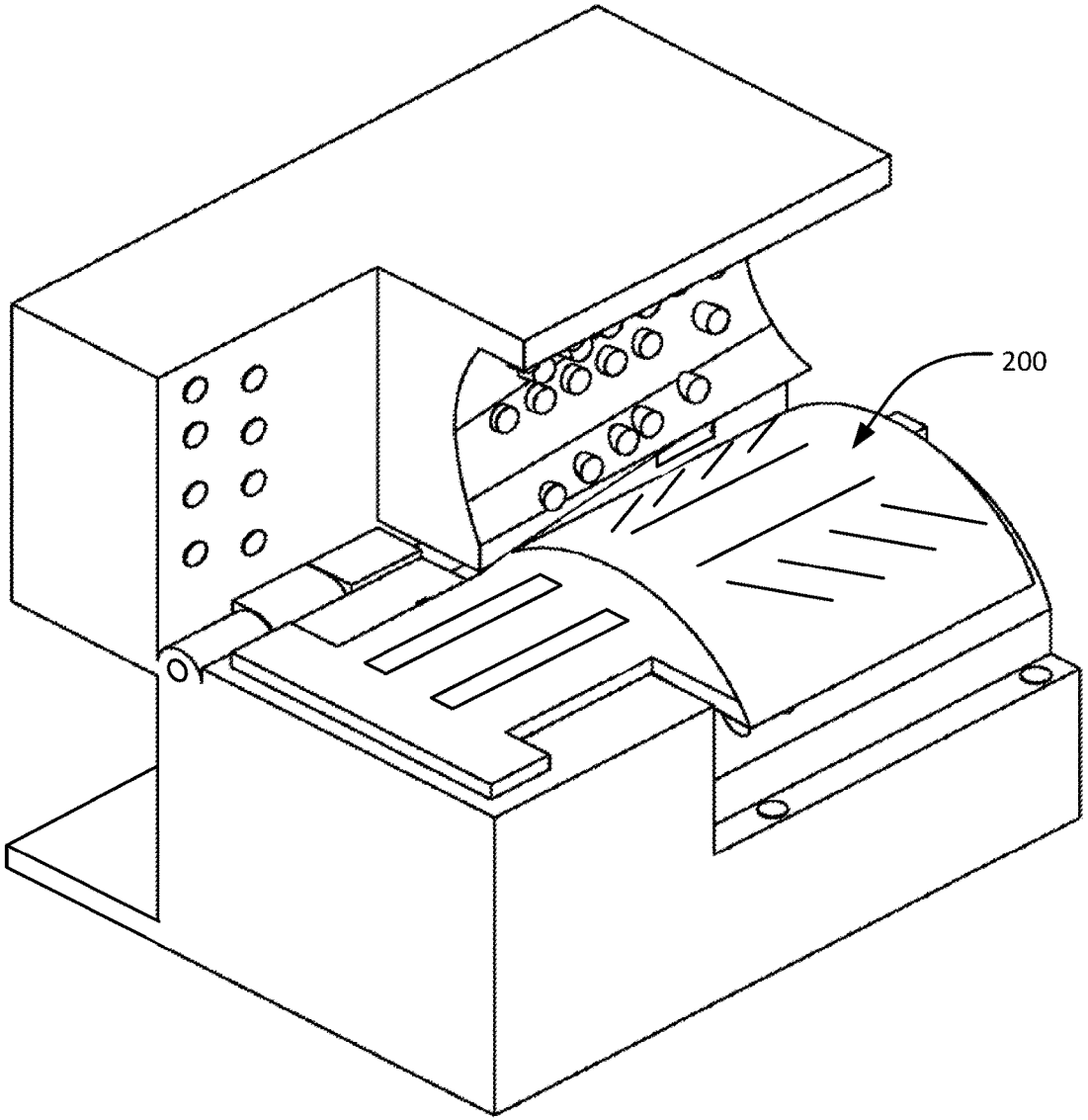
FIG. 4 is a perspective view of the core pattern reforming tool of FIG. 1 in an open position, shown with a core pattern situated therein.
Figure 5:
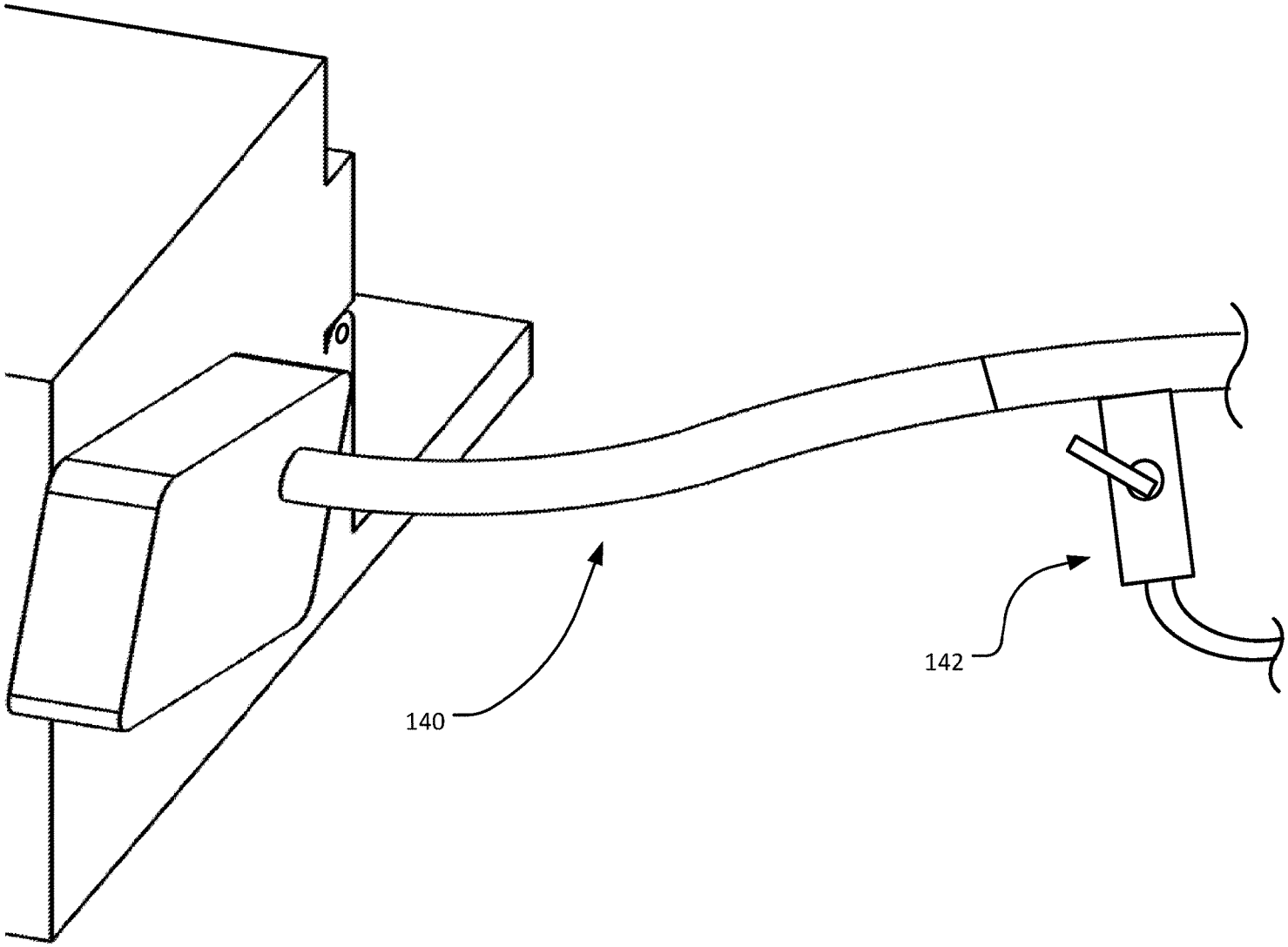
FIG. 5 is a perspective view illustrating a supply of cooling air to be fed to the core pattern reforming tool of FIG. 1.

Referring first to FIGS. 1 and 2, the reformer tool 100 may have a first portion 102, and a second portion 104. In embodiments, the first portion 102 may be movably coupled to the second portion 104. For example, and as shown in FIG. 3, the first portion 102 may be hingedly coupled to the second portion 104 via one or more hinges 106, which may allow the reformer tool 100 to be opened and closed. FIGS. 1, 2, 6, and 7 show the reformer tool 100 in a closed position, and FIGS. 3, and 4 show the reformer tool 100 in the open position.

The first portion 102 may have an external face 110 (FIG. 1) and an internal face 112 (FIG. 3). The second portion may likewise have an external face 114 (FIG. 1) and an internal face 116 (FIG. 3). The external faces 110 and 114 of the first portion 102 and the second portion 104, respectively, may be generally planar.

The internal faces 112 and 116 of the first portion 102 and the second portion 104, respectively, may be curved at least in part. For example, the first portion internal face 112 or a segment 112C thereof may be curved (e.g., be one of generally concave and generally convex) and the second portion internal face 116 or a segment 116C thereof may be generally curved (e.g., be the other of generally concave and generally convex). The artisan understands that airfoils of gas turbine blades and vanes may have a generally concave pressure surface and a generally convex suction surface. The core pattern used to form the core, therefore, may also have a concave surface and a convex surface. The curved segments 112C and 116C of the first portion internal face 112 and the second portion internal face 116, respectively, may allow for the concave and convex surfaces of the core pattern to be maintained while the core pattern is situated in the tool 100 and allowed to set. In embodiments, the internal faces 112 and 116 of the first portion 102 and the second portion 104, respectively, may also include one or more segments that are generally planar, e.g., segments 112P and 116P. The shape of the internal faces 112 and 116 may be generally configured to collectively correspond to the profile of the core.

The first portion 102 may include one or more adjustable pins 120 (FIG. 3). Each adjustable pin 120 may have a reforming end 120R (FIG. 3) protruding from the internal face 112 away from the external face 110, and a pin outer end 1200 (FIG. 6) opposite the pin reforming end 120R. The reforming end 120R of each pin 120 may be planar, rounded, or otherwise be contoured to generally conform to the desired shape of a corresponding section of the core pattern to be situated in the tool 100. As discussed herein, during operation, the reforming end 120R may be proximate or contact the core pattern situated within the tool 100. A user may selectively adjust the distance between the pin reforming end 120R and the first portion internal face 112 (i.e., the user may selectively determine how far the pin 120 is to protrude from the internal face 112), and thereby, adjust the shape of the core pattern itself as desired. The adjustable pins 120 may be strategically situated in areas corresponding to sections of the core pattern most likely to require tweaking. In embodiments, the first portion 102 may include other pins in addition to the adjustable pins 120.

Each adjustable pin 120 may, in embodiments, be adjusted using a corresponding set screw 122 (FIG. 6) provided on the first portion 102 (e.g., on a side panel thereof), or via other suitable means. For example, and with reference to FIG. 7, each adjustable pin 120 may have a flat 120F against which the corresponding set screw 122 may lock. Rotating the set screw 122 in one direction (e.g., clockwise) may cause the adjustable pin 120 to protrude further away from the internal face 112 whereas rotating the set screw 122 in the other direction (e.g., counter clockwise) may cause the distance between the pin reforming end 120R and the internal face 112 to be reduced. The set screw 122 may also be used to hold the pin 120 associated therewith in place, to maintain the desired contour of the core pattern situated within the tool 100.

Figure 6:
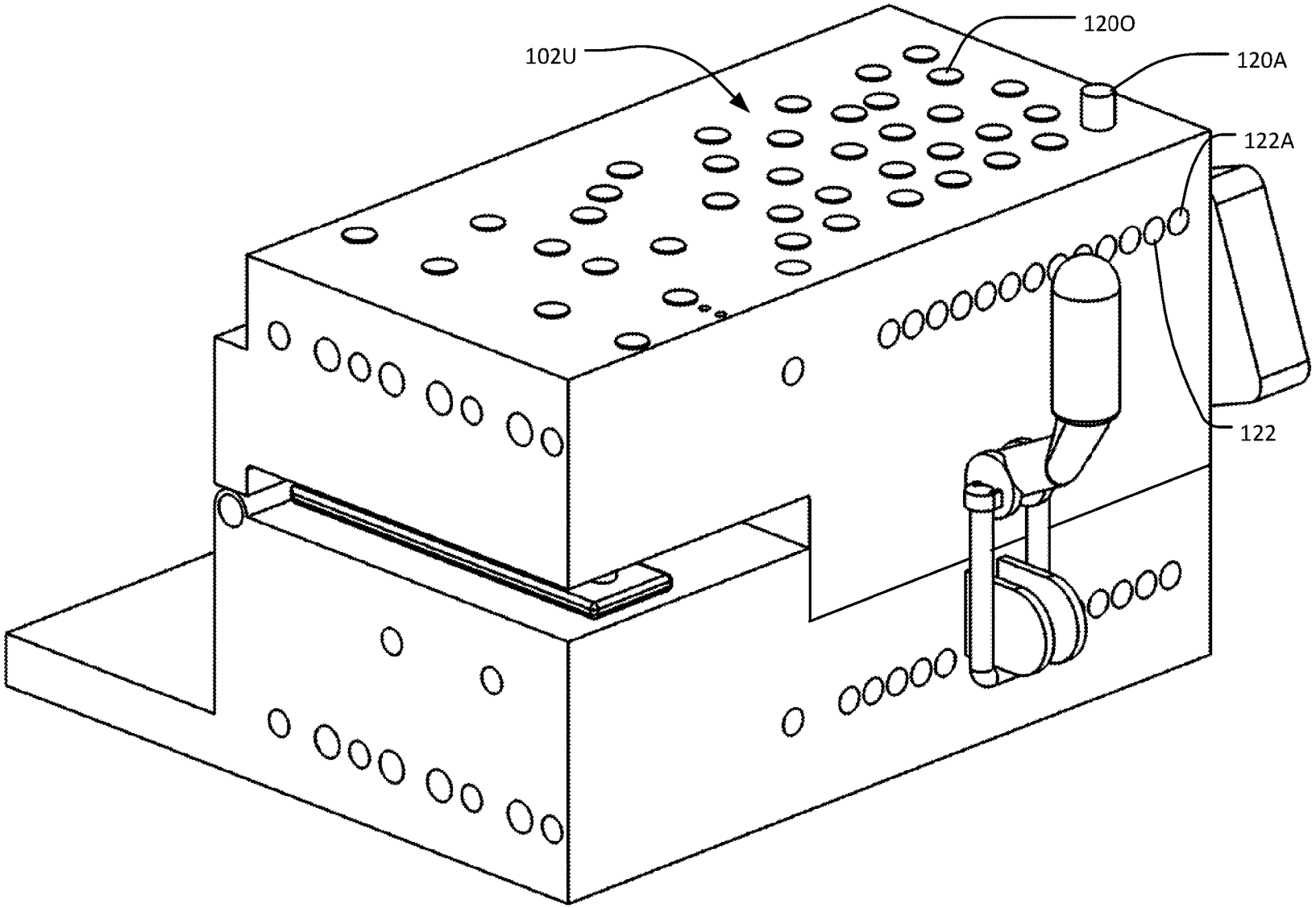
FIG. 6 is a perspective view of the core pattern reforming tool of FIG. 1 shown with a cover plate thereof removed.
Figure 7:
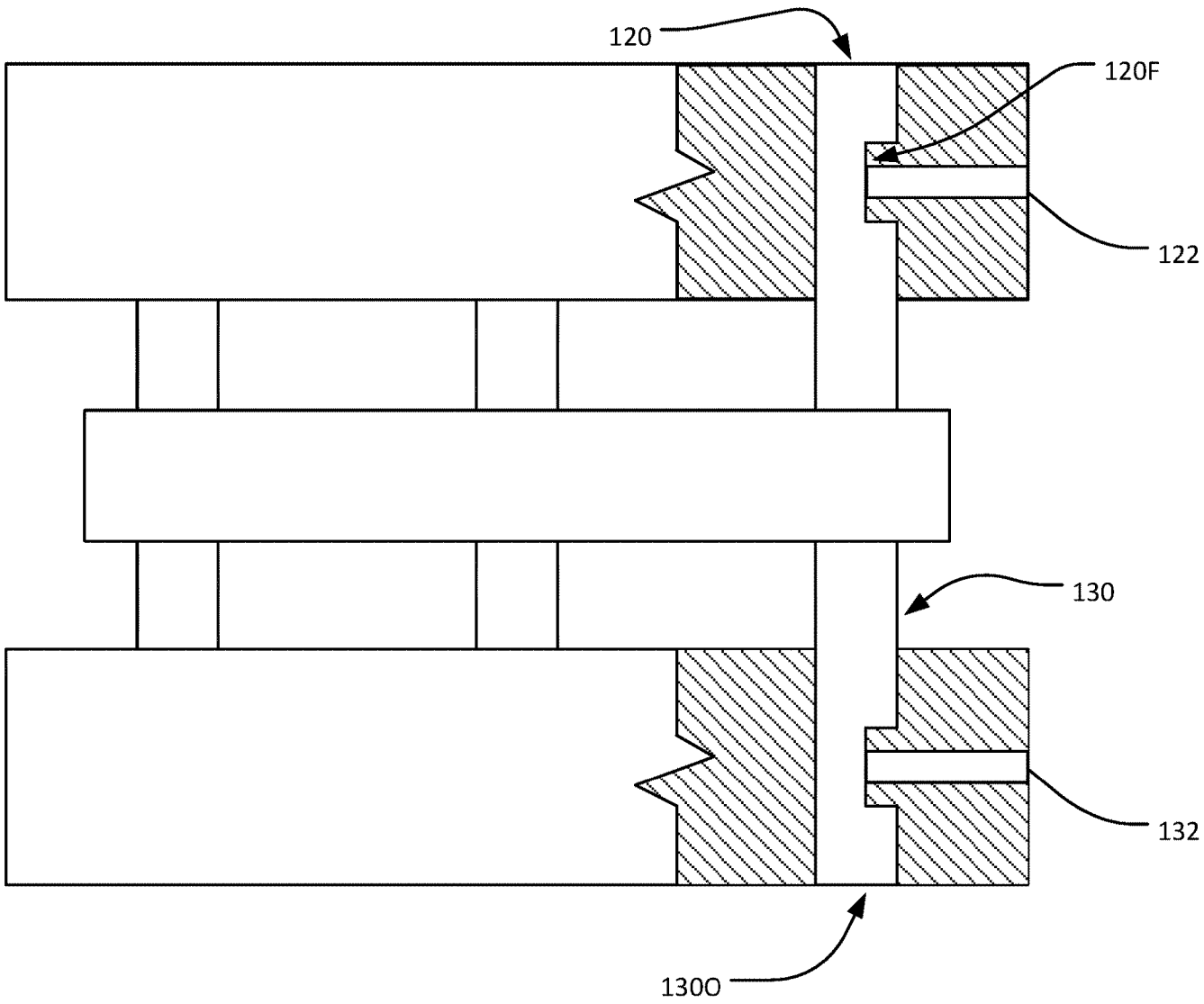
FIG. 7 is a schematic view depicting a core pattern located in the core pattern reforming tool of FIG. 1.

In a nominal position, the outer end 1200 of each pin 120 may be flush with an upper surface 102U (FIG. 6) of the first portion 102. Such a configuration may visually underscore for the user those pins 120 that have been adjusted. FIG. 6, for example, shows a pin 120A that has been moved relative to its nominal position via a corresponding set screw 122A. In embodiments, identifying markings may be provided on the set screws 122 and the adjustable pins 120 to indicate which set screw 122 corresponds to a particular adjustable pin 120. The user may use a dial indicator or other suitable means to precisely measure the adjustment made to any pin 120. In practice, the adjustment required to a pin 120 may be no greater than a fraction of an inch (e.g., 0.020 inches, 0.050 inches, etc.).

Much like the first portion adjustable pins 120, the second portion 104 may have adjustable pins 130 (FIG. 3) that protrude upward from the internal face 116 of the second portion 104. These pins 130 may likewise have a reforming end 130R that may be contoured to generally conform to the desired shape of the corresponding core pattern section, and an outer end 1300 (FIG. 7) opposite the reforming end 130R. The pins 130 may be selectively adjusted (i.e., the reforming end 130R may be moved closer to or further away from the internal face 116) using corresponding set screws 132, as discussed above for the pins 120. Collectively, the adjustable pins 120, 130 and set screws 122, 132 may allow the user to selectively make one or more of many possible adjustments to the core pattern situated within the tool 100.

The first portion 102, at an outer (e.g., upper) surface 102U thereof, may have a cover plate 134 (FIG. 1) coupled thereto. The cover plate 134 may be removably coupled to the outer surface 102U, and may protect components of the tool 100 (e.g., the pins 120 thereof) from impact. In embodiments, a cover plate may also be removably or otherwise coupled to an outer surface of the second portion 104.

The second portion 104, at a back side 103B (FIG. 1) of the tool 100, may include a counterbalancing member 136. The counterbalancing member 136 of the second portion 104 may cause the second portion 104 to extend at the back side 103B beyond the first portion 102. The counterbalancing member 136 may ensure that the tool 100 does not topple over when the tool 100 is placed in open position.

The reformer tool 100 may have a locking mechanism 138. The locking mechanism 138 may comprise, e.g., hasp and loop, a lever handle lock, a clamp, a rim/mortise lock, and/or other suitable locking mechanism. The locking mechanism 138 may allow for the first portion 102 to be locked to the second portion 104 to curtail relative movement therebetween.

The tool 100 may have an air feeding mechanism 140 (FIG. 5) configured to allow air to be selectively fed to the tool 100. In an embodiment, the air feeding mechanism 140 may comprise a vortex air chiller 142 that can, upon user command, feed cold air to the tool inner surfaces via a pipe. The cool air fed via the air feeding mechanism 140 may flow through the tool 100, contact the core pattern situated therein, and cause the core pattern to set in the position supported by the reformer tool 100. In embodiments, the tool 100 may have one or more gaps or exits 144 (FIG. 1) that allow the cold air fed via the air feeding mechanism 140 to exit the tool 100 after it has flown around the core pattern.

In operation, the user may use the set screws 122 and 132 to respectively adjust and lock the adjustable pins 120 and 130 as desired to make bow and twist adjustments to individual core features and passages of the core, based, e.g., on dimensional data obtained from previously made cores and/or wax pattern studies. The user may place the tool 100 in the open position, remove the core pattern 200 (FIG. 4) from the mold, and situate the core pattern 200 within the tool 100 while the core pattern 200 is still warm (e.g., at about 100 degrees Fahrenheit) and pliable. The user may then close the tool 100 and use the locking mechanism 138 to lock the tool 100 in the closed position. One or more surfaces of the core pattern 200 may be adjusted by the pins 120, 130 while the core pattern 200 is situated within the tool. The user may use the air feeding mechanism 140 to feed chilled air (e.g., at about 40 degrees Fahrenheit) into the tool 100. The chilled air may flow around the core pattern 200, cause the core pattern 200 to set over time, and flow out the gaps 144. Once the core pattern 200 is set, the user may unlock the tool 100, place it in the open position, and remove the core pattern 200 for downstream processing.

While the figures show the tool 100 of a particular shape, the artisan will understand from the disclosure herein that such is merely exemplary and the tool 100 may take on other shapes as desired depending on the desired configuration of the core. In general, the tool 100 may be manufactured to core die size.

Although a preferred embodiment of this disclosure has been disclosed, a worker of ordinary skill in this art would recognize that certain modifications would come within the scope of this disclosure. For that reason, the following claims should be studied to determine the true scope and content of this disclosure. Since many possible embodiments may be made of the disclosure without departing from the scope thereof, it is to be understood that all matter herein set forth or shown in the accompanying drawings is to be interpreted as illustrative and not in a limiting sense.

From the foregoing, it will be seen that this disclosure is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Having thus described the disclosure, what is claimed is:

1. A reforming tool for a core pattern comprising:

a first portion having a first internal face with a concave portion;

a second portion having a second internal face with a convex portion;

a plurality of adjustable pins extending away from the first and second internal faces, the pins having a height that is adjustable with respect to the first and second internal faces;

a locking mechanism for securing the first portion to the second portion;

one or more air inlets; and, one or more air exits;

wherein the core pattern is supported and repositioned within the reforming tool by the plurality of adjustable pins and is cooled by air passing through the reforming tool.

2. The reforming tool of claim 1 further comprising a vortex air chiller coupled to the one or more air inlets.

3. The reforming tool of claim 1, wherein a set screw is used to adjust a position of the pin.

4. The reforming tool of claim 3, wherein the set screw is accessed through a side panel of the first portion and the second portion.

5. The reforming tool of claim 1, wherein the pins are adjustable to be flush with the first and second internal faces.

6. The reforming tool of claim 1, wherein the first portion is hinged to the second portion.

7. The reforming tool of claim 1, wherein a surface of the adjustable pins in contact with the core pattern are contoured similar to a contour of the core pattern.

8. A system for adjusting and setting a core pattern for use in casting a gas turbine blade, the system comprising:

a first portion having a first internal face with a concave portion, the first portion coupled to a second portion, the second portion having a second internal face with a convex portion;

a plurality of adjustable pins positioned along the internal faces of the first portion and the second portion, the pins having a height that is adjustable with respect to the internal faces;

a locking mechanism for securing the first portion to the second portion;

one or more air inlets and one or more air exits; and, a source of cooling air coupled to the one or more air inlets.

9. The system of claim 8, wherein the plurality of adjustable pins has a top surface contoured similar to the first internal face or the second internal face.

10. The system of claim 8, wherein the source of cooling air is a vortex air chiller.

11. The system of claim 8 further comprising a cover plate positioned over an outer surface of first portion and the second portion.

12. The system of claim 8, wherein the adjustable pins are moved via a plurality of set screws accessible through one or more sides of the first portion and the second portion.

13. A reforming tool for a core pattern comprising:

a first portion having a first internal face with a concave portion;

a second portion having a second internal face with a convex portion;

a first plurality of adjustable pins extending within the first portion, the first plurality of adjustable pins having a height that is adjustable with respect to the first internal face;

a second plurality of adjustable pins extending within the second portion, the second plurality of adjustable pins having a height that is adjustable with respect to the second internal face;

a locking mechanism for securing the first portion to the second portion;

one or more air inlets; and, one or more air exits;

wherein:

the core pattern is supported and repositioned within the reforming tool by both the first plurality of adjustable pins and the second plurality of adjustable pins; and the core pattern is cooled by air passing through the reforming tool.

14. The reforming tool of claim 13 further comprising a vortex air chiller coupled to the one or more air inlets.

15. The reforming tool of claim 13, wherein a set screw is used to adjust a position of at least one of the first plurality of pins.

16. The reforming tool of claim 15, wherein the set screw is accessed through a side panel of the first portion and the second portion.

17. The reforming tool of claim 13, wherein the first plurality of pins is adjustable to be flush with the first internal face and the second plurality of pins is adjustable to be flush with the second internal face.

18. The reforming tool of claim 13, wherein the first portion is hinged to the second portion.

19. The reforming tool of claim 13, wherein a surface of at least one of the first plurality of adjustable pins and the second plurality of adjustable pins in contact with the core pattern is contoured similar to a contour of the core pattern.

20. The system of claim 13 further comprising a cover plate positioned over an outer surface of the first portion and the second portion.

* * * * *